US006852023B2

(12) United States Patent
Hediger et al.

(10) Patent No.: US 6,852,023 B2
(45) Date of Patent: Feb. 8, 2005

(54) LINER ADAPTOR FOR CHIMNEYS

(75) Inventors: Elvin D. Hediger, Lemont, IL (US); Karen K. Stickels, Douds, IA (US); Ronald J. Lach, Dickinson, ND (US); Michael J. Corbin, Cameron, NC (US); Russell A. Dimmit, Fairfield, IA (US); Tony Smith, Fairfield, IA (US)

(73) Assignee: Copperfield Chimney Supply, Inc., Fairfield, IA (US)

( * ) Notice: Subject to any disclaimer, the term of this patent is extended or adjusted under 35 U.S.C. 154(b) by 0 days.

(21) Appl. No.: 10/347,517

(22) Filed: Jan. 21, 2003

(65) Prior Publication Data

US 2004/0142652 A1 Jul. 22, 2004

(51) Int. Cl.[7] ..... F23J 13/02
(52) U.S. Cl. ..... 454/44; 126/85 B
(58) Field of Search ..... 454/44, 46, 47, 454/121, 126, 156, 159, 160; 52/199, 198; 165/41, 42; 237/12.3 B

(56) References Cited

U.S. PATENT DOCUMENTS 38,946 A * 6/1863 Chase ..... 454/44
3,087,408 A * 4/1963 Carr ..... 454/44
4,191,099 A * 3/1980 Strahl ..... 454/46
4,380,189 A * 4/1983 Vicard ..... 454/46
4,387,628 A * 6/1983 Sapp ..... 454/46
4,466,340 A * 8/1984 Briner ..... 454/46
4,545,293 A * 10/1985 Munz ..... 454/46
4,607,665 A * 8/1986 Williams ..... 138/148
4,893,608 A * 1/1990 Reaser ..... 126/85 B

* cited by examiner

*Primary Examiner*—Derek S. Boles
(74) *Attorney, Agent, or Firm*—Dickstein Shapiro Morin and Oshinsky LLP

(57) ABSTRACT

A chimney liner adaptor is provided to allow air to flow between the outside environment and an annular space in a lined chimney flue. The adaptor may allow an air cooling system to operate but prevents undesirable elements from entering the annular space. The liner adaptor may be disposed between the chimney cap and the top walls of the chimney system and around the chimney liner. The adaptor may include perforated material, such as an expanded metal mesh, a metal screen, stamped metal screen, rugged netting, or the like. The perforated material permits gas flow, provides structural support for other elements of the adaptor, and filters out undesirable objects from entering the chimney.

22 Claims, 4 Drawing Sheets

LINER ADAPTOR FOR CHIMNEYS

BACKGROUND

The present invention relates generally to a chimney liner adaptor for protecting the open end of the annular space of a chimney flue from the ingress of undesirable elements.

It is well known that chimney caps are often desired to prevent the ingress of undesirable elements into the upper end of a chimney flue. For example, the undesirable elements may include birds, squirrels, and rain. It is also known that chimney caps are desired to prevent the egress of embers from the upper end of the chimney flue. In many chimney systems, a chimney liner is disposed within a chimney flue. For example, when a masonry chimney flue develops cracks or leaks in its side walls due to deterioration over time or other reasons, the installation of a chimney liner within the flue is a cost-effective way to repair the deteriorated flue. The hot gases and combustion products are contained within the liner. Such liners are often round conduit or pipe made of corrosion resistant material such as stainless steel.

In some chimney systems, the chimney liner is disposed within a multi-wall factory-built type chimney. Generally, a factory-built chimney is a double-walled round conduit or pipe, with the inner wall spaced from the outer wall. The inner wall is the flue for the hot gases and combustion products. The annulus formed between the two pipe walls acts as insulation, so that the outer wall stays cool enough to be installed in close proximity, e.g., within one to two (1–2) inches, of combustible materials. Also, cooling air may flow through the annulus by forced or natural convection. Some factory-built chimney pipes have three walls and/or insulation positioned between two of the walls. For example, a factory-built chimney for wood-burning fireplaces is marketed by Hearth Technologies Inc., dba Heatilator, of Mt. Pleasant, Iowa.

When a liner is installed within a factory-built chimney, another annular "inner chimney space" is formed between the outside of the chimney liner and the inside wall of the factory-built chimney. Therefore, it is desirable to permit the movement of cooling air through this inner chimney space to exit to the outside environment. However, when a chimney cap is attached to such a chimney system to prevent the ingress of undesirable elements into the chimney liner, it may block the air circulation to the inner chimney space. Chimney caps are known that permit the circulation of air to the inner chimney space. However, these known devices fail to prevent the ingress of undesirable elements into the inner chimney space. Therefore, it would be desirable to have a chimney liner adaptor that prevents the ingress of undesirable elements into the inner chimney space and also permits the use of a chimney liner cap to prevent the ingress of undesirable elements into the chimney liner.

SUMMARY

The invention provides a chimney liner adaptor that prevents the ingress of undesirable elements into the inner chimney space but permits an air exchange between the inner chimney space and the outside environment. The invention also permits the use of a chimney cap to prevent the ingress of undesirable elements into the chimney liner. According to one aspect of the invention, a chimney liner adaptor comprises an apertured element for permitting air flow between a chimney and the outside environment; and a device for supporting the apertured element on the chimney.

In another aspect, the chimney liner adaptor comprises a first perforated disc in a first plane having an aperture; and a second disc having a second aperture, the second disc being disposed above and substantially parallel to the first plane, the second disc being connected to the first disc, the diameter of the first aperture being substantially equal to the diameter of the second aperture; and wherein the second disc is adapted to be disposed on top of the chimney annulus, and the first and second apertures are adapted to receive a chimney liner.

The present invention can be used to terminate a chimney lining in a multi-wall factory built pipe installation without obstructing the designed circulation, while at the same time preventing birds and small animals from entering the chimney walls. This may be accomplished by the use of stainless steel mesh covering the entire opening on the underside of the adaptor. The operation of the liner adaptor achieves the designed air flow of the multi-wall lining pipe by keeping the air flow separated from the smoke and fumes of the fire.

A further objective is to allow a chimney cap, for example a HomeSaver® Pro™ Guardian™ cap, to be installed on multi-wall factory-built pipe lined with stainless steel pipe. The use of a top clamp and storm collar with the liner adaptor allows installation of the readily available chimney caps by chimney professionals. An additional benefit of the liner adaptor is the added support to the relining pipe achieved by the use of the top clamp and the storm collar. The top clamp grips the lining pipe and supports the pipe by distributing the weight to the storm collar which is then distributed to the adaptor and finally to the multi-wall pipe.

These and other features and advantages of the invention will be more readily understood from the following detailed description of a preferred embodiment which is provided in connection with the accompanying drawings.

DETAILED DESCRIPTION OF PREFERRED EMBODIMENTS

Figure 1:
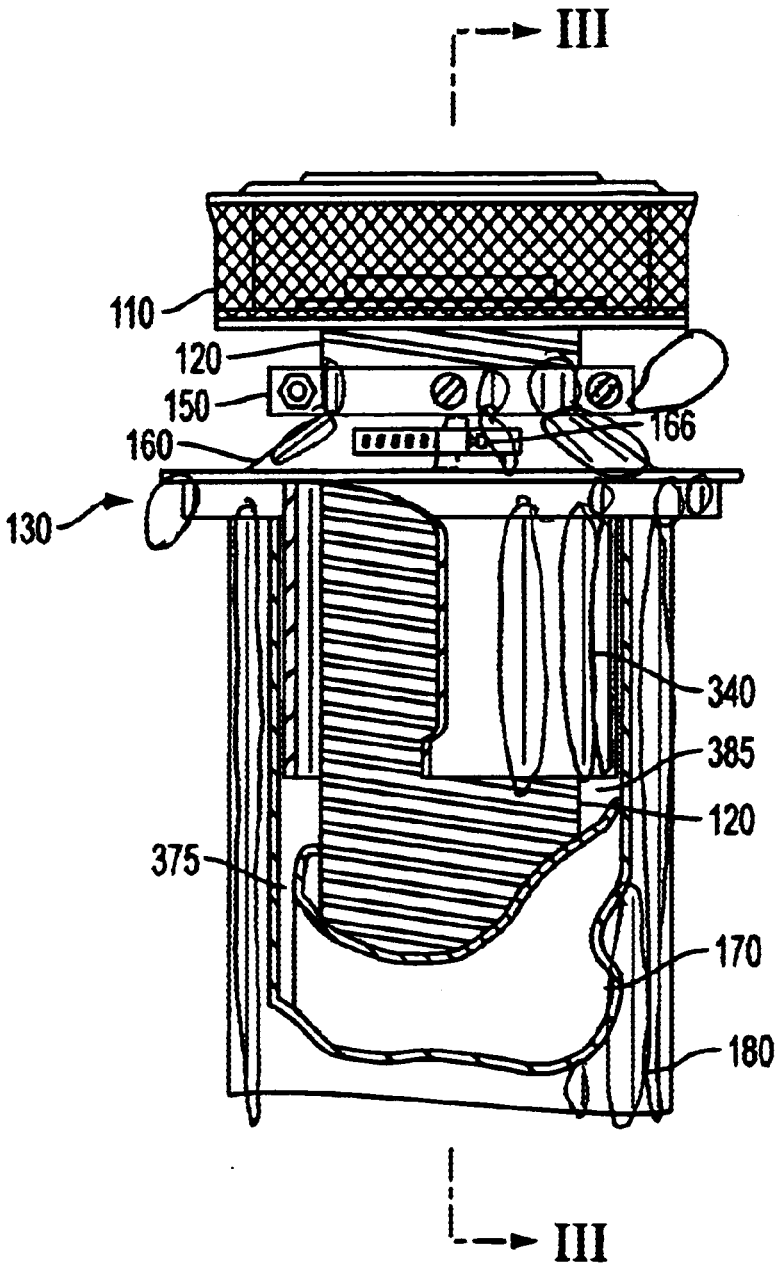
FIG. 1 is a partial cut-away elevation view of a chimney liner adaptor in a chimney system, according to a preferred embodiment of the present invention.

FIG. 1 shows a chimney system according to a preferred embodiment of the present invention, where the chimney liner adaptor 130 is disposed over the outer wall 180 and around the chimney liner 120. A chimney cap 110 is disposed above, and coupled to, the liner 120.

Figure 2:
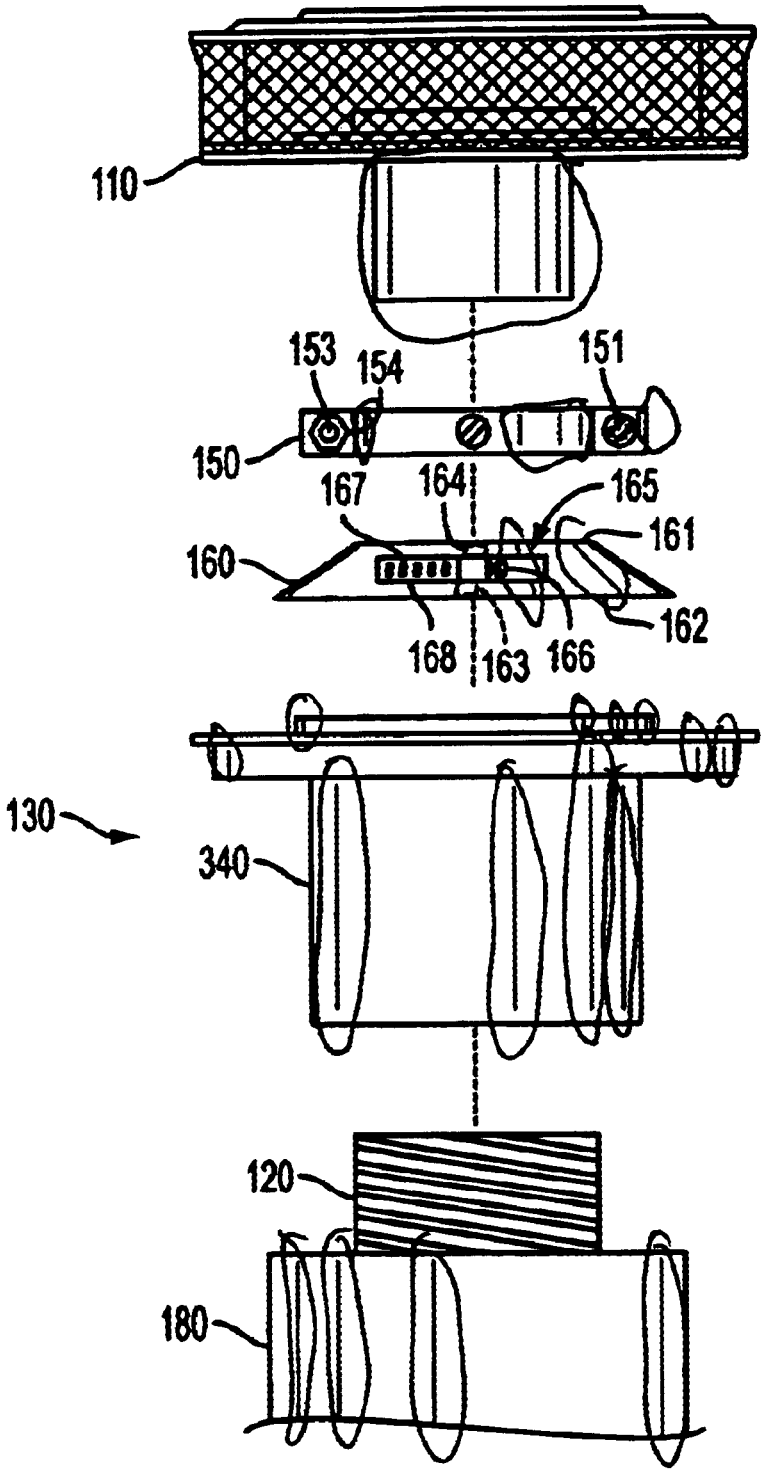
FIG. 2 is an exploded view of the chimney system of FIG. 1.

FIGS. 1 and 2 show the outer wall 180 which is substantially cylindrical in shape. An inner wall 170 is disposed within the outer wall 180 and is substantially cylindrical in shape. The longitudinal axis of the inner wall 170 is substantially aligned with the longitudinal axis of the outer wall 180. The annular space 375 between the inner wall 170 and the outer wall 180 is the area generally referred to as the inner chimney space. The insert collar 340 of the chimney liner adaptor 130 is disposed within the inner wall 170. The longitudinal axis of the collar 340 is substantially aligned with the longitudinal axis of the inner wall 170. The chimney liner 120 is substantially cylindrical in shape and is disposed within the inner wall 120 and partially disposed within the collar 340. The longitudinal axis of the liner 120 is substantially aligned with the longitudinal axis of the inner wall 170.

The inner chimney space can also include the annular space 385 between the inner wall 170 and the liner 120. Part of the chimney liner adaptor 130 that extends radially from the collar 340 (FIG. 4) is disposed above the outer wall 180. Disposed above the liner adaptor 130 is the storm collar 160. A top clamp 150 is disposed above the storm collar 160. A chimney cap 110 is disposed above the top clamp 150 and is coupled to the liner 120. The inner wall 170 may be any suitable size, but in a preferred embodiment, it is substantially eight inches in diameter.

Figure 4:
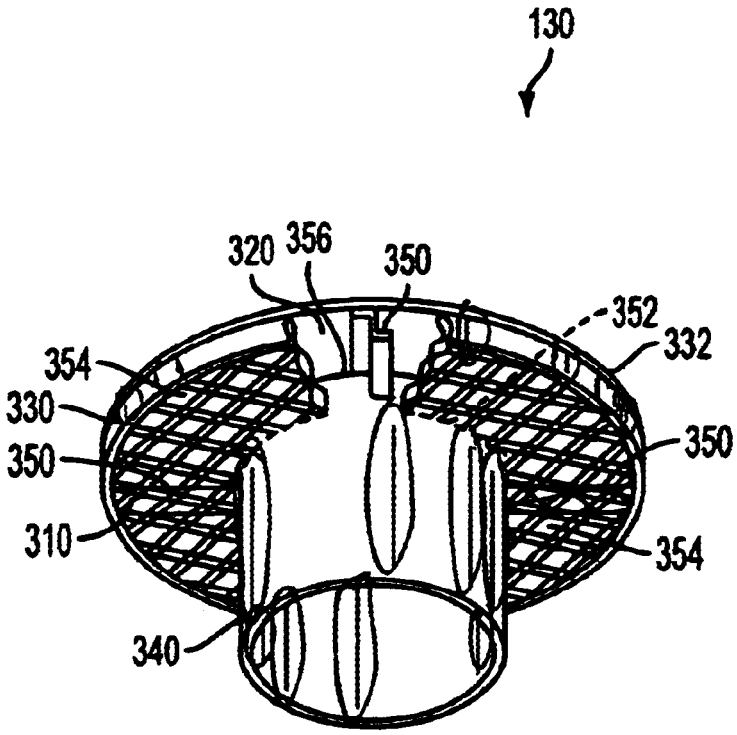
FIG. 4 is a partially broken-away perspective view of the chimney liner adaptor of FIG. 1.

The storm collar 160 is a bezel-shaped metal, preferably formed of stainless steel, having an inner diameter slightly larger than the diameter of the liner 120 and an outer diameter smaller than the diameter of disc 320 (FIG. 4). The cone shaped storm collar 160 (FIG. 1) has its smaller diameter opening 161 at the top, a conical-shaped sidewall, and the larger diameter opening 162 at the bottom. The collar 160 is split with overlapping ends 163 and 164. A clamp 165 may be adjusted to tighten the collar 160 around the liner 120 by pulling the collar end 163 over the overlapping collar end 164. In the illustrated embodiment, the clamp 165 operates similar to an automotive hose clamp with a mounted screw 166 that engages slots 167 in strap 168 attached to the collar 160.

The top clamp 150 is formed from two "c" clamps. Each "c" clamp is formed from a rectangular metal strip having three sections, the first and third sections being substantially co-planar. The second section, disposed between the first and third sections, is substantially arc shaped, where the diameter of the arc is substantially equal to the diameter of the liner 120. The top clamp 150 is implemented by the two "c" clamps joined such that the respective arcs form a cylinder, respective first sections abut, and the respective third sections abut. These respective sections are mechanically coupled after installation by screws, nuts and bolts, or the like. In a preferred embodiment, each first and third sections of both "c" clamps have a respective aperture 151, 153 which are substantially similar in diameter and adapted to receive a screw. The apertures 151, 153 are disposed such that when the first section of one "c" clamp is in contact with the third section of the other "c" clamp the respective centers of apertures 151, 153 are substantially aligned. In another aspect, a nut 154 is connected to the third section of each "c" clamp. The aperture of nut 154 has a diameter that is substantially similar to the diameter of the apertures 151, 153. The aperture of each nut 154 is substantially coaxial to the apertures 151, 153.

Referring now to FIG. 4, the liner adaptor 130 is comprised of a mesh disc 310, a metal disc 320, a cylindrical band 330, the collar 340, and mesh supports 350. There are four mesh supports 350 in the illustrated embodiment. One of the mesh supports 350 is hidden from view in FIG. 4 by the collar 340. The present invention should not be limited, however, to the details of the preferred embodiments shown and described herein.

The mesh disc 310 is preferably formed from a substantially planar, perforated material, preferably stainless steel. The perforated material may be, for example, an expanded metal mesh, a metal screen, stamped metal screen, rugged netting, or the like. The mesh disc 310 has a diameter sufficiently larger than the diameter of the chimney pipe 180 (FIG. 1) to permit effective air exchange between the inner chimney space and the outside environment. The disc 310 has an aperture 352 having a diameter that is smaller than the diameter of the inner wall 170 and a diameter slightly larger than the liner 120. The mesh disc 310 is formed from material with apertures, or perforations, 354 sufficiently large to permit air flow into and/or out of the annular space, but sufficiently small enough to prevent ingress of undesirable elements, e.g., small animals.

The disc 320 has a diameter sufficiently larger than the diameter of the chimney pipe 180. The disc 320 has an aperture 356 having a diameter that is smaller than the diameter of the inner wall 170 and a diameter larger than the liner 120. The diameter of the aperture 352 of the mesh disc 310 corresponds to, and is substantially equal to, the diameter of the aperture 356 of the disc 320. The outer diameter of the mesh disc 310 corresponds to, and is slightly smaller than, the outer diameter of the disc 320. In a preferred embodiment, the respective diameter of the apertures 352, 356 of discs 310, 320 is substantially equal to seven and eleven sixteenths ($7\frac{11}{16}$) inches. In a preferred embodiment, the outer diameter of discs 310 is substantially equal to sixteen (16) inches and the outer diameter of discs 320 is substantially equal to sixteen and three quarters ($16\frac{3}{4}$) inches. The diameters of discs 310, 320 is such that liner adapter 130 is adapted to be used with different chimney systems having different sized outer walls 180.

The band 330 is formed from a substantially rectangular strip of metal, preferably stainless steel, to form a cylinder. The length of band 330 corresponds to the (exterior) radius of the disc 310. In a preferred embodiment the height of the band 330 is substantially equal to one and one half ($1\frac{1}{2}$) inches. The band 330 may also have a flange 332 extending from one end of the cylinder being formed away from the exterior. The flange 332 is approximately one quarter ($\frac{1}{4}$) inch in the radial direction.

The collar 340 is substantially cylindrically shaped having on one end a small flange projecting away from, and substantially perpendicular to, the exterior wall of the collar 340. In a preferred embodiment, the collar 340 is formed of stainless steel. The diameter of the collar 340 is substantially equal to the respective diameters of the apertures 352, 356 of the discs 310, 320. In a preferred embodiment, the length of the collar 340 is substantially equal to five and one half ($5\frac{1}{2}$) inches and the flange is approximately one quarter ($\frac{1}{4}$) inch in length. As noted above, however, the present invention should not be limited to the details of the illustrated embodiments.

The mesh support 350, or standoff, may be formed from rectangularly shaped metal pieces. In the illustrated embodiment, each rectangularly shaped metal piece is bent a first time forming a first section that is substantially perpendicular to a second section. The metal piece is bent a second time along an imaginary line that is parallel to an imaginary line formed by the first bend. The third section is substantially perpendicular to the second section and bent away from the side of section two where section one is disposed. The plane formed by section one is substantially parallel to the plane formed by section three.

The disc 320, which may be turned from sheet metal, is disposed in a plane parallel to and above the plane formed by disc 310. The center point of the aperture of disc 320 is substantially aligned with the center point of the aperture of disc 310. Four mesh supports 350 couple disc 310 to disc 320. Preferably, each mesh support 350 is substantially at a radial position on discs 310, 320 ninety (90) degrees from the neighboring mesh support 350. Each respective first section of a mesh support 350 is substantially parallel to a plane formed by disc 310 and substantially flush and coupled to the disc 310. Each respective third section of a mesh support 350 is substantially parallel to a plane formed by disc 320 and substantially flush and coupled to disc 320. In the illustrated embodiment, mesh supports 350 are coupled to discs 310, 320 by resistance welding.

Collar 340 is disposed through the apertures of discs 310, 320 such that the bottom of the flange on collar 340 is coupled with the top surface of disc 320. The length of the collar 350 extends through the aperture on discs 310, 320 and the collar extends below disc 310. In a preferred embodiment, the flange of the collar 340 is resistance welded to the surface of disc 320.

The band 330 is bent lengthwise and shaped into a cylinder where one lengthwise end of the band 330 abuts and is coupled to the other lengthwise end of the band 330. The bottom circumference of the cylinder formed by the band 330 is disposed and may be coupled to the circumference of the disc 310 by resistance welding. The top circumference of the cylinder formed by the band 330 and the flange is disposed and coupled to the bottom side of the disc 320, preferably by resistance welding.

The liner adaptor 130 is disposed such that the liner 120 is disposed within and extends through the collar 340. The collar 340 of the liner adaptor 130 is disposed within the inner wall 170. The bottom side of the liner 130, e.g., the mesh disc 310, is disposed on the top of either the inner or outer walls 170, 180, depending on which is higher. In many chimney systems, the inner and outer walls 170, 180 are substantially the same height. The diameter of the mesh disc 310 should be substantially larger than the diameter of the outer wall 180. There is an annular region 365 in the liner adaptor 130 bounded by the liner 120 and the band 330 and the mesh disc 310 and the disc 320. Air is permitted to flow freely from/to the inner chimney space through the annular space 365.

The storm collar 160 is disposed above and abuts the top surface of the liner adaptor 130, and has an outward slope in a downward direction. The top clamp 150 is disposed above the storm collar 160. A benefit of the illustrated arrangement is that added support is provided for the upper portion of the liner 120. The upper portion of the liner 120 is supported in part by the top clamp 150 and the storm collar 160. The top clamp 150 grips the liner 120 and supports the liner 120 by distributing the weight to the storm collar 160 which is then distributed to the liner adaptor 130 and finally to the multi-wall pipe 180. The chimney cap 110 is disposed above the top clamp 150 and coupled to the liner 120.

Figure 3:
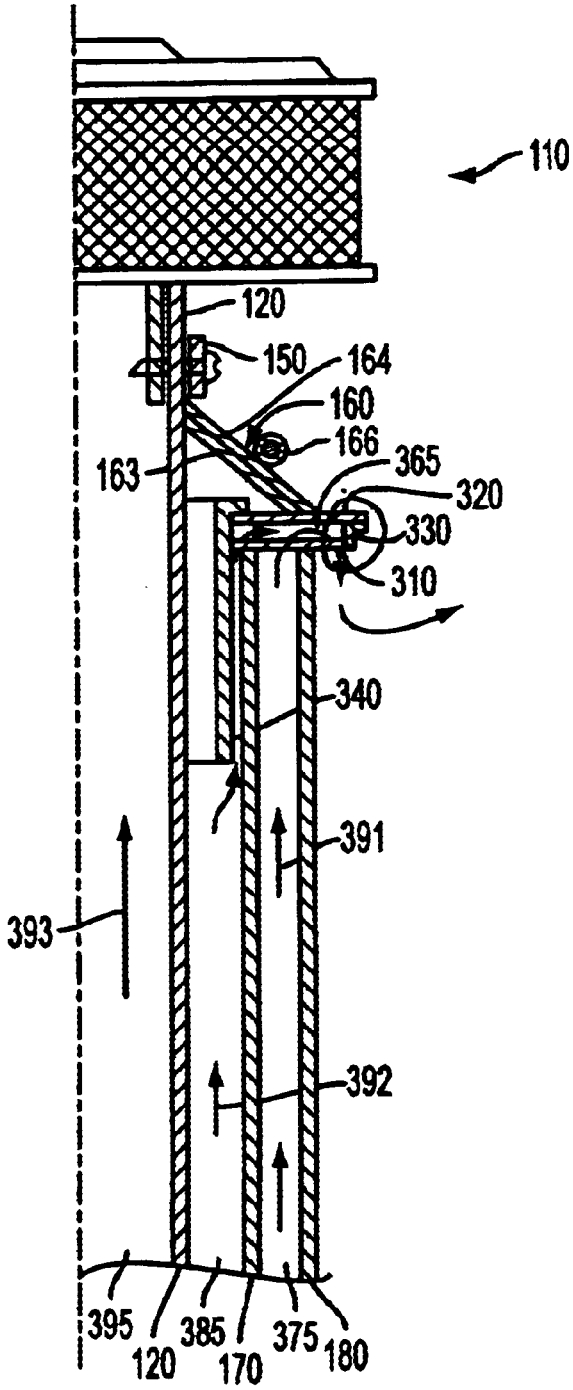
FIG. 3 is a partial cross-section view taken along section line III—III of FIG. 1.

As seen in FIG. 3, the chimney system permits the egress of fumes carried in the annular space 395 within the liner 120 to the chimney cap 110 into the outside environment. The flow of air, e.g., fumes, egressing annular space 395 is indicated by arrow 393. The illustrated arrangement also permits the circulation of air in the inner chimney space, e.g., annular spaces 375, 385, with the outside environment. Air from annular space 375 is carried between the outer wall 180 and inner wall 170 and through the mesh disc 310 on the interior side of the outer wall 180 and subsequently through the mesh disc 310 on the exterior side of the outer wall 180 into the environment. The flow of air egressing annular space 375 is indicated by arrow 391. It may be desirable that air be permitted to flow in the reverse direction as well.

Air from annular space 385 can be carried between the inner wall 170 and the liner 120 and through the mesh disc 310 on the interior side of the inner wall 170 and subsequently through the mesh disc 310 on the exterior side of the outer wall 180 into the environment. The flow of air egressing annular space 385 is indicated by arrow 392. It may also be desirable that air be permitted to flow though space 385 in the reverse direction. The air circulation may be dependent upon the existence and size of the annular area between the collar 340 and the inner wall 170. However, the presence and use of the mesh disc 310 as part of the liner adaptor 130 prevents undesirable elements, e.g., rodents, from outside the chimney system from entering into the chimney system.

While the invention has been described and illustrated with reference to specific exemplary embodiments, it should be understood that many modifications and substitutions can be made without departing from the spirit and scope of the invention. The invention is not to be considered as limited by the foregoing description but is only limited by the scope of the claims.

What is claimed as new and desired to be protected by Letters Patent of the United States is:

1. A chimney liner adaptor, comprising:

an apertured element for permitting air flow between a chimney and the outside environment, said aperture of said apertured element adapted to receive a chimney liner and having a diameter larger than a diameter of said liner and smaller than a diameter of an inner wall of said chimney; and a standoff for supporting said chimney liner adaptor on said chimney, said standoff mechanically coupled to said apertured element.

2. The liner adaptor of claim 1, wherein said apertured element has a mesh configuration.

3. The liner adaptor of claim 1, wherein said apertured element is formed of expanded metal.

4. The liner adaptor of claim 1, wherein said chimney has multiple spaced-apart walls.

5. A chimney liner adaptor that permits air flow between a chimney annulus and the outside environment, said adaptor comprising:

a first perforated disc in a first plane having an aperture, said aperture adapted to receive a chimney liner and having a diameter larger than a diameter of said liner and smaller than a diameter of an inner wall of said chimney; and a second disc having a second aperture, said second disc being disposed above and substantially parallel to said first plane, said second disc being connected to said first disc, the diameter of said first aperture being substantially equal to the diameter of said second aperture; and wherein said second disc is adapted to be disposed above the chimney annulus, and said first and second apertures are adapted to receive said chimney liner.

6. The liner adaptor of claim 5, further comprising a collar disposed through said first and second apertures, said collar being adapted to receive said liner.

7. The liner adaptor of claim 6, further comprising a standoff for supporting one of said discs relative to the other, said standoff being located between said first and second discs.

8. The liner adaptor of claim 7, further comprising a band for defining the outer perimeter of said adaptor, said band being located around the perimeter of said first disc.

9. The liner adaptor of claim 8, wherein said perforated disc is formed of expanded stainless steel.

10. The liner adaptor of claim 9, wherein said chimney is a factory built chimney.

11. The liner adaptor of claim 10, wherein said chimney has an inner and an outer wall.

12. A chimney system, comprising:

a liner for lining a flue; and a liner adaptor comprising:

a perforated disc for allowing gas to flow into and/or out of said flue, said perforated disc being located in a first plane, said perforated disc having a first aperture, said aperture having a diameter larger than a diameter of said liner and smaller than a diameter of an inner wall of a chimney; and a non-perforated disc having a second aperture, said non-perforated disc being disposed above and substantially parallel to said first plane, said non-perforated disc being connected to said perforated disc, the diameter of said first aperture being substantially equal to the diameter of said second aperture; and wherein said first and second apertures are adapted to receive said chimney liner.

13. The chimney system of claim 12, further comprising a collar disposed through said first and second apertures, said collar being adapted to receive said liner.

14. The chimney system of claim 13, further comprising a standoff for supporting one of said discs relative to the other, said standoff being located between said discs.

15. The chimney system of claim 14, further comprising a band for defining the outer perimeter of said adaptor, said band being located around the perimeter of said perforated disc.

16. The chimney system of claim 15, further comprising a chimney cap being disposed above said liner adaptor and coupled to said liner.

17. The liner adaptor of claim 1 wherein said apertured element is substantially perforated throughout.

18. The liner adaptor of claim 6 wherein said collar has a diameter larger than a diameter of said liner and smaller than a diameter of an inner wall of said chimney.

19. The liner adaptor of claim 5 wherein said first disc is substantially perforated throughout.

20. The chimney system of claim 12 wherein said perforated disc is substantially perforated throughout.

21. The chimney system of claim 12 further comprising a storm collar for supporting the liner, said storm collar having a inner diameter larger than said diameter of said liner and adapted to be placed over said non-perforated disc.

22. The chimney system of claim 21 wherein said storm collar is adjustable.

* * * * *

UNITED STATES PATENT AND TRADEMARK OFFICE

CERTIFICATE OF CORRECTION

PATENT NO. : 6,852,023 B2
DATED : February 8, 2005
INVENTOR(S) : Elvin D. Hediger et al.

It is certified that error appears in the above-identified patent and that said Letters Patent is hereby corrected as shown below:

Title page,
Item [75], Inventor, "Dickinson, ND" should read -- Pinehurst, NC --.

Column 3,
Line 1, "within the inner wall 120" should read -- within the inner wall 170 --.
Line 19, "(FIG. 1)" should read -- (FIG. 2) --.

Column 4,
Line 21, "the outer diameter of discs 310" should read -- the outer diameter of disc 310 --.
Line 22, "the outer diameter of discs 320" should read -- the outer diameter of disc 320 --.
Line 60, "which may be turned" should read -- which may be stamped --.

Column 5,
Line 11, "collar 350" should read -- collar 340 --.

Signed and Sealed this

Fifth Day of July, 2005

JON W. DUDAS
*Director of the United States Patent and Trademark Office*